United States Patent [19]

Eickmann

[11] Patent Number: 4,550,644

[45] Date of Patent: Nov. 5, 1985

[54] DRIVE SHAFT ARRANGEMENT TO REDUCE LEAKAGE IN FLUID MACHINES

[76] Inventor: Karl Eickmann, 2420 Isshiki, Hayama-machi, Kanagawa-ken, Japan

[21] Appl. No.: 575,622

[22] Filed: Jan. 31, 1984

Related U.S. Application Data

[60] Continuation-in-part of Ser. No. 235,058, Feb. 17, 1981, abandoned, which is a division of Ser. No. 910,809, May 30, 1978, abandoned, which is a division of Ser. No. 911,246, May 31, 1978, abandoned.

[51] Int. Cl.[4] ..... F01B 13/06

[52] U.S. Cl. ..... 91/486; 91/496

[58] Field of Search ..... 91/488, 486, 493–498

[56] References Cited

U.S. PATENT DOCUMENTS

| | | | |
|---|---|---|---|
| 658,014 | 9/1900 | Johnson | 91/498 |
| 717,897 | 1/1903 | McCulloch | 91/495 |
| 932,033 | 8/1909 | Krone | 91/492 |
| 1,843,338 | 2/1932 | Roplogle | 91/494 |

FOREIGN PATENT DOCUMENTS

| | | | |
|---|---|---|---|
| 1403789 | 3/1969 | Fed. Rep. of Germany | 91/498 |
| 649437 | 12/1928 | France | 91/498 |
| 1022136 | 2/1953 | France | 91/495 |

*Primary Examiner*—William L. Freeh

[57] ABSTRACT

In a fluid machine, wherein fluid flows through working chambers, as in pumps, compressors, motors, transmissions, a rotor and a drive shaft are revolvingly borne in the housing of the machine. Since slight departures of the axes of the rotor and shaft from each other might result in wearing of faces or in widened clearances in the machine, the shaft and rotor are coupled flexibly. The coupling is managed by providing the drive shaft with arms or fingers and the rotor with gaps whereby the gaps are extending into the axially seen medial rotor portion. The arms or fingers are engaging the walls of the gaps in the mentioned medial rotor portion, whereby tilting components of forces, which might occur, when the coupling would be on an axial end of the rotor, are prevented.

2 Claims, 6 Drawing Figures

ENLARGEMENT
157
158
160
159
161
162

ENLARGEMENT
144
157
158
156
156
159
162
MEDIAL PORTION OF ROTOR

MEDIAL PORTION OF ROTOR
56
144
157
158
156
92
149
148
146
147
145
153
154
152
163
159
ENLARGEMENT
ENLARGEMENT
I
II

Fig. 4
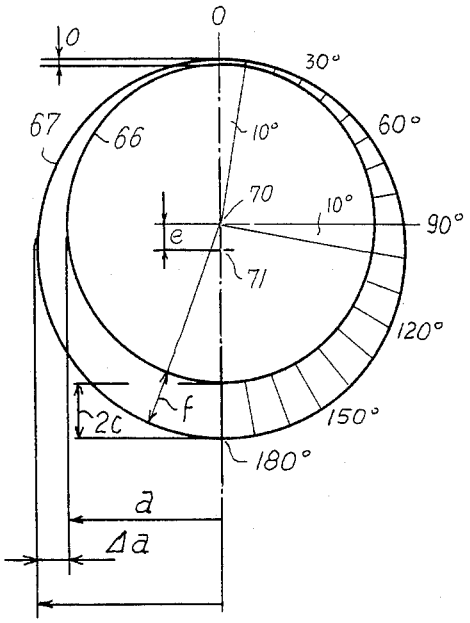
Fig. 3
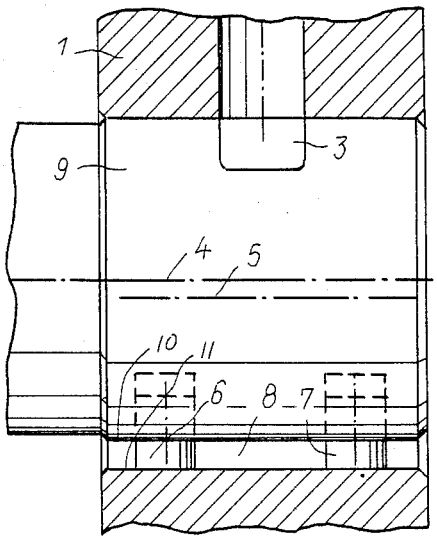
Fig. 6
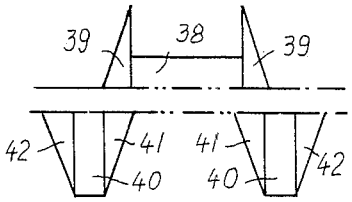
Fig. 5
| α° | 0 | 10 | 20 | 30 | 40 | 50 | 60 | 70 | 80 | 90 | Σ | 90 | 100 | 110 | 120 | 130 | 140 | 150 | 160 | 170 | 180 | Σ |
|---|---|---|---|---|---|---|---|---|---|---|---|---|---|---|---|---|---|---|---|---|---|---|
| F | 0 | .05 | .08 | .16 | .27 | .42 | .57 | .74 | .92 | 1.09 | | 1.09 | 1.27 | 1.43 | 1.57 | 1.70 | 1.81 | 1.90 | 1.95 | 1.99 | 2.0 | |
| $F^3$ | 0 | 0 | 0 | .01 | .02 | .07 | .19 | .41 | .77 | 1.31 | 2.77 | 1.31 | 2.05 | 2.89 | 3.88 | 4.86 | 5.88 | 6.86 | 7.43 | 7.86 | 8 | 51.05 |
| $\overline{F^3}$ | 2.77 /10 INTERVALS = 0.28 | | | | | | | | | | | 51.05 /10 INTERVALS = 5.10 | | | | | | | | | | |

DRIVE SHAFT ARRANGEMENT TO REDUCE LEAKAGE IN FLUID MACHINES

REFERENCE TO RELATED APPLICATIONS

This is a continuation in part patent application of my earlier application Ser. No. 06-235,058, now abandoned which was filed on 02-17-81 as a divisional application of my grand parental patent applications Ser. No. 910,809, filed on May 30th, 1978 and Ser. No. 911,246, filed on May 31st, 1978. Benefits of both applications are claimed herewith for this present application. FIGS. 1 and 2 of the present application are true copies of FIGS. 24 and 23 of the mentioned grand parental applications. Applications Ser. Nos. 910,809 and 911,246 are now abandoned.

BACKGROUND OF THE INVENTION (a) Field of the Invention

This invention relates to machines, wherein a shaft drives a rotor and a flexible coupling is provided between the shaft and the rotor. Such flexible coupling is especially required in fluid machines, like pumps or motors, because in such machines the rotor must be free of uncentering when it floats around a control body. A typical machine of this field is shown in my Pat. No. 3,223,046.

(b) Description of the Prior Art

The prior art is best demonstrated in my mentioned U.S. Pat. No. 3,223,046. Therein a shaft, which is borne in the housing, is provided with fingers, which engage into recesses, which are provided on the shaft-nearest end of the rotor, while the rotor is radially borne on and floating around a stationary fixed cylindrical control body.

The described former art has the difficulty that at high pressures in fluid and high powers in the machine, the fingers of the shaft tend to exert a slight tilting force onto the rotor. At low pressures and power the tilting forces were too low to prevent the rotor from centric revolving. But with the current increased power and pressure requirements in the machines, the forces, which tend to tilt the rotor, are becoming too high and at such high pressures and power the rotor of the prior art can become stuck or welded onto the control body.

In other former art the U.S. Pat. No. 3,750,533 has the means of my above mentioned patent. The McCulloch Pat. No. 717,897 has a drive plate with slots between the shaft and the rotor but before the rotor. The French Pat. No. 1,022,136 of Ladousse has an eccentric rotor prevented from rotation by a pin which extends through a slot in the rotor. The Joensson Pat. No. 658,014 has a swing member mounted in a recess which extend half way into the rotor. The Replogle Pat. No. 1,843,338 has a swing member arrangement which extends with pins which swing through slots in the rotor, to permit long radial movements of the swing pin relative to the rotor.

The Benedek Pat. No. 2,137,936 has radially adjustable pins which extend through radially and peripheral wide slots in the rotor. The Krone Pat. No. 932,033 has drive plates on the end of the rotor. The French Pat. No. 649,437 has a drive plate on the end of a rotor wherein the drive plate has radially extending slots and pins which are fastened in the rotor, engage the slots and extend into the slots. The Wilking Pat. No. 1,714,706 has one single arm with a pin and a slide shoe which enters into a radially extended slot to permit a large eccentricity between two rotary members.

Of the above mentioned patents of the former art all patents except my own Pat. No. 3,223,046 and the Thoma Pat. No. 3,750,533 deal with rough rapid movements on rotors, where the rotors are strongly forced to run concentrically relative to the control body. The strong enforcement of concentric running permits engagements which can have friction or imperfect designs.

My own Pat. No. 3,223,046 and the Thoma Pat. No. 3,750,533 have the rotor floated concentrically relative to the control body.

On the contrary to all the devices of the former art, my present invention permits the rotor to float eccentrically relative to the control body in order to decrease the leakage between the rotor and the control body.

SUMMARY OF THE INVENTION

It is recognized by the present invention, that the tilting forces of the former art are caused thereby, that the fingers of the coupling were acting on one end of the rotor.

With this discovery, the invention aims to overcome the difficulties of the former art and does so by locating the coupling faces away from the rotor end and provides them axially seen in the medial portion of the rotor. In addition the coupling faces may be moved radially more outwards.

It is an object of the invention to provide a drive means for the rotor which permits small forces of fluid in the clearance between the control body and the rotor to let the rotor revolve in a predetermined location relative to the control body without disturbing of the mentioned location by the drive means. Consequently, the drive means of the invention are of such kind that the friction of the drive means and the tilting forces of the drive means are smaller than the small forces of fluid in the clearance between the rotor and the control body.

It is therefore another object of the invention to provide such drive means to the rotor wherein the friction between the driving fingers or shoes and the respective reception face of the driving shoe of the finger are smaller than the small forces of fluid in the clearance between the rotor and the control body.

An additional aim and object of the invention is, therefore, to provide a stable drive means to a rotor wherein all details of the drive means are of such design and manufacturing that the forces between the drive means and the rotor are reduced to a minimum or that they are almost entirely eliminated.

And, it is a final object and aim of the invention, to permit the rotor to float eccentrically relative to the control body in order to reduce drastically the leakage between the rotor and the control body. This final object of the invention thereby aims to provide a drive means to a rotor which permits not only a relative radial movement between the drive shaft and the rotor but in addition thereto also a relative radial movement between the rotor and the control body during revolutions of the rotor around the control body.

BRIEF DESCRIPTION OF THE DRAWING

FIGS. 3 to 6 are explanatory Figures and graphical diagrams to explain the basic technology of the invention.

DESCRIPTION OF THE PREFERRED EMBODIMENT

Figures 1, 2:
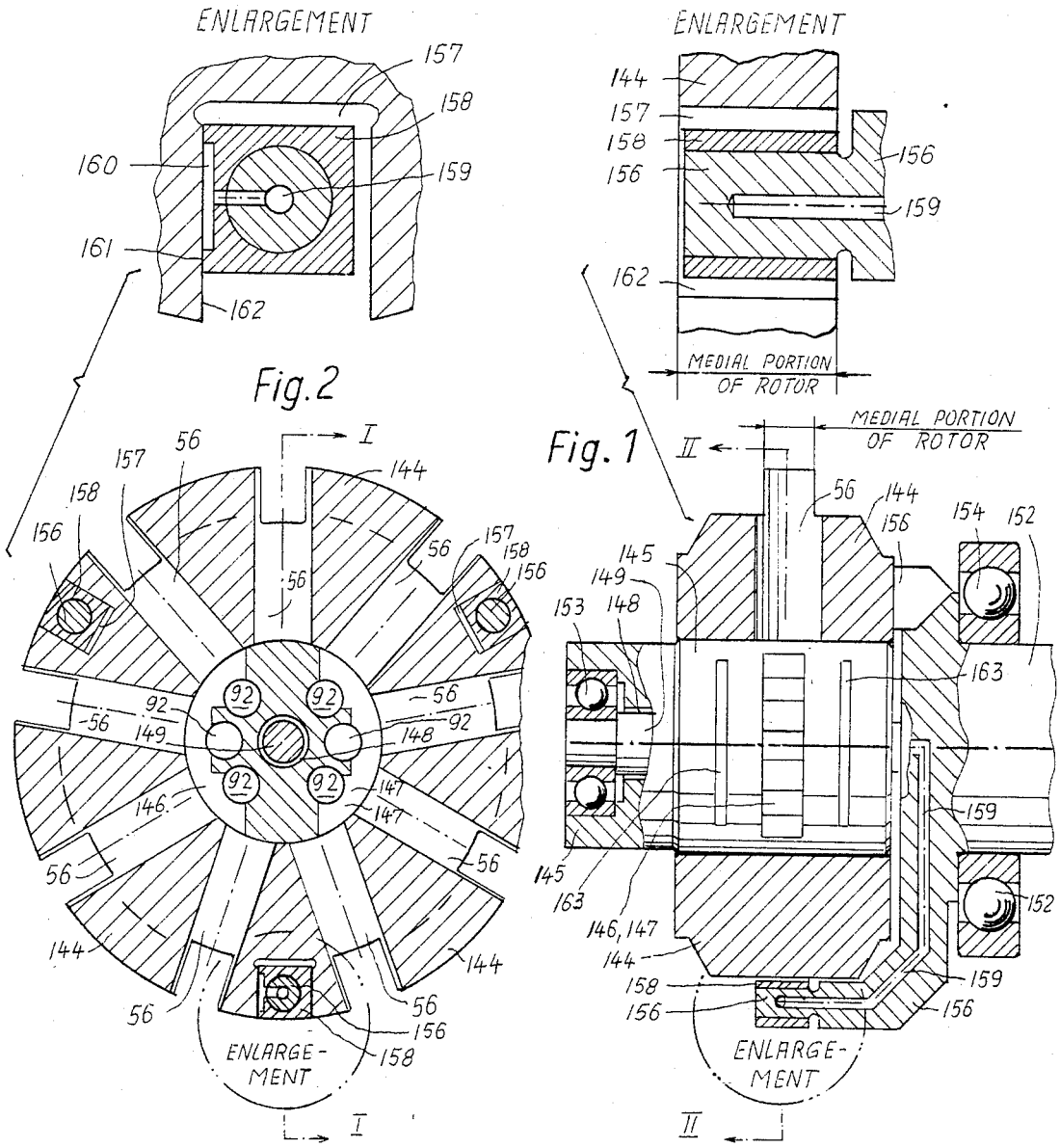
FIG. 1 is a longitudinal sectional view through an embodiment of the invention.
FIG. 2 is a cross-sectional view through FIG. 1 aong the line II—II, whereby FIG. 1 also is a sectional view through FIG. 2 along the line I—I of FIG. 2.

At the description of the grand parental applications it has become apparent, that there are two possibilities of location of the rotor relative to the control body. The one is, that they float relative to each other to a common axis. The other is, that they are relative to each other radially displaced so, that they are eccentric relative to each other and that their axes are distanced from each other. Such distance is in practice less than a few hundredth of a millimeter and often only a few thousands of a millimeter. The mentioned other possibility of eccentricity between rotor and controlbody is scientifically, technically and geometrically considered, an undesired and imperfect case. The ever increasing pressure in fluid machines, however, demands sometimes a compromise in favor of a tighter seal. It can, therefore, presently no more be entirely prevented to intentionally provide an eccentrical running of the rotor relative to the control body in order to obtain a smaller clearance on the respective high pressure control port half of the control body and thereby to obtain a tighter seal and less leakage at the high pressure side of the clearance between rotor and control body. The market demands this application because the fluid machine shall be inexpensive and of little weight.

Such eccentricity between rotor and control body demands, that the rotor is radially moveable relative to the controlbody. Because during revolution of the rotor the rotor floats with its inner face one degree after the other a little bit towards the outer face of the controlbody at one half and away from it on the other half of the respective revolution. The flexibility or radial moveability of the rotor relative to the control body is already obtained in the former art by the insertion of a crosswise slotted disc between the shaft and the rotor of the fluid machine at which fingers or extensions of the rotor and shaft enter cross-wise the slots of the crosswise slotted disc. This is also done in order to prevent uncentered running of the shaft on the rotor, because such unround running of the less accurate machined and borne shaft would stick and weld the more accurately machined inner face of the rotor onto the outer face of the control body, since the clearance between them may be smaller than the accuracy of the bearings, which bear the shaft of the fluid machine.

The embodiment of the invention of FIGS. 1 and 2 demonstrates effective arrangements to permit and assure the required ability of relative radial movement between the outer face of the control body 145 and the inner face of the rotor 144. For said purpose the arrangement includes the provision of radial recesses 157 in the rotor 144 or in a cross-slotted disc before the rotor 144 and the provision of extensions or fingers 156 of a cross-disc or of shaft 152 for the engagement onto at least one wall of said slot or slots 157. Shaft 152 may be concentrically borne in bearings 152 in the housing or cover of the machine and/or in the control body 145 by bearings 154 or 154 and 153. The control body 145 may be concentric relative to said shaft 152, so that both have the same axis. The rotor 144 revolves a little bit eccentrically relative to said axis of said shaft and of said rotor, as known from earlier Figures of the grand parental applications. The engagement portions, extensions or fingers 156 of shaft 152 engage into respective slots 157 in rotor 144 for driving the same or to be driven by the same. The slots 157 are wider in radial direction than the fingers 156 are, and are able to move radially in or partially out of said slots 157. Thus, the fingers 156 are in a limited extent able to move radially in the slots 157 whereby the radial delocation of the rotor relative to the shaft is permitted during operation and driving of one by the other.

For easy move of the fingers 156 along the respective wall of the respective slot it is preferred to set slide shoes 158 around the fingers for engagement on a respective wall of the respective slot 157.

For a still better operation of the device and for more easy relative radial movement of the rotor 144 it is possible to provide fluid pressure pockets between the fingers and shoes 156–158 or between the slot walls 162 and the thrust faces 161 of the slide shoes 158. These fluid pressure pockets 160 lubricate the said faces 161 and 162 or the faces between fingers 156 and shoes 158 relative to each other at their relative movement and they reduce the friction between the faces. The fluid pressure pockets are shown by numbers 160 and they are filled with fluid under pressure through the passage(s) 159 which extend(s) through the finger(s) 146 and through shaft 152 into a space with fluid under pressure. For example to a respective high pressure part in the control body 145. Passage(s) 159 may for that purpose extend from shaft 152 into control body 145 and a sealing means—not shown in the Figure—may seal the extension of the respective passage 159 from the shaft 152 into the control body 145.

A stable bearing of the revolvable shaft 152 can be obtained, for example, by extending a portion 149 of shaft 152 through a bore 148 through the control body 145 for bearing the shaft 152 at both ends of the fluid machine.

For the precision of the driving of shaft 152 or of rotor 144 by the other of these two elements, the slots 157 are employed in the medial portion of the rotor 144 or on medial means in the middle between both axial ends of the rotor 144. In practice however it is often preferred to engage the rotor by the shaft of vice versa on one end of the rotor because the machining is then easier and the costs of the fluid machine is thereby reduced. For high quality operation the engagement of shaft and rotor on one end of the rotor is not so good technologically because it might result in an inclination of the rotor relative to the outer face of the control body. That might result in increased friction and leakage between them.

It is desired to make the fingers or arms 156 strong enough in design to prevent deformation.

The main care however is to be taken to the necessity, that the friction of relative radial move between rotor 144 and shaft 152 remains less than the forces exerted by the several embodiments of the invention or by one of them for pressing the rotor and the controlbody together or for narrowing the clearance between them at the high pressure control port half of the control body.

Control body 145 may have control ports 146 and 147 and passages 92 as well as restriction recesses or balancing recesses 163 for the purposes as in other embodiments of the parental application.

The housings, which are mentioned in this specification and claims, as well as the bearings, which bear the rotor in the housing or bear the shaft in the housing are not shown in the drawings and Figures because the arrangement of the rotor and shaft in a housing is generally known from my older patents, which are mentioned in this specification.

The great effects of the invention may be best understood from FIGS. 3 to 6. As is already described, the arrangement to the invention permits an eccentric floating of the rotor relative to the control body because the arrangement of the invention permits a relative radial movement between the shaft and the rotor and between the rotor to the control body.

The forces which hold the rotor in the eccentric position relative to the control body are, however, very small because they are fluid pressure forces only and a too strong eccentric location of the rotor relative to the control body would lead to wear and weld of the outer face of the control body on the inner face of the rotor. That is the reason why the fingers of the arrangement engage exclusively the medial portion of the rotor. If the fingers would touch with lines or faces over the entire length of the rotor, unaccuracy of parallelities would be unavoidable and the easy drive of the rotor without tilting forces would not be possible.

FIG. 3 demonstrates such eccentric running of the rotor 1 relative to the control body 9. The axis of the rotor is 5 and the axis of the control body is shown by 4. Since these axes 4 and 5 are distanced from each other in the Figure, there is an eccentricity provided between the rotor 1 and the control body 9. This eccentricity is obtained by the insertion of thrust bodies 6 and 7 into the control body 9. These thrust bodies 6 and 7 press the outer face 10 of control body 9 upwards and away from the inner face 11 of rotor 1 in FIG. 3 whereby a big clearance 8 appears on the bottom of FIG. 3, while in the upper portion of the Figure the outer face of the control body is close to the inner face of the rotor. Since in high pressure and high quality machines the difference of the diameters of the inner face of the rotor and of the outer face of the control body is only 0.001 to 0.002 of the inner diameter of the rotor, the clearance 8 is shown in FIG. 3 very extensively enlarged in order to make the system of the invention better understandable.

In FIG. 4 such eccentric arrangement is shown in a mathematical explanation. The clearance between the mentioned inner face and outer face is defined as "2*c*". The local clearance is defined by "f".

The eccentricity between axes 70 and 71 of FIG. 4, which correspond to axes 4 and 5 of FIG. 3, is defined by "e". The radius of the control body is shown by "a" and the difference of the radii of the outer face of the control body and of the inner face of the rotor is shown in FIG. 4 by "delta a". The clearance is on the right side of FIG. 4 divided into a number of values "f" by intervals of ten degrees. The outer face of the control body is in FIG. 4 shown by 66 and the inner diameter of the inner face of the rotor by 67. The lengths of the local clearance differences, namely the differences "delta a" or values "f" are to be calculated by the following formula:

$$f = e \cos \alpha - (e^2/2R) \sin^2 \alpha \qquad (1)$$

with $\alpha$ = angle of interval calculated from "O", and R = radius of the inner face 67 of the hub of the rotor. From the mentioned formula the table of FIG. 5 is obtained. Therein "f" at 180 degrees is given as an example by the value 2. Since "f" at 180 degrees equals the mentioned "2*c*", the eccentricity "e" is the half of it, namely 1. The measures 1 and 2 are about 100 times exaggerated relative to the actual clearances. But the exaggeration does not change the outcome when the local clearances are considered. However, the exaggeration of the sizes makes it better visible to the studying eye how the eccentric location of the rotor relative to the control body effects the reduction of the leakage through the mentioned clearance. The flow of leakage through a clearance is parallel to the third power of the radial dimension "f" of the clearance. The local values of the third power of "f" are added in FIG. 5. The left portion of FIG. 5 sums up the values between 0 and 90 degrees of FIG. 4, while the right portion sums up the values between 90 and 180 degrees of FIG. 4. The sums are divided by the number of intervals taken.

The result is a medial value "$f^3$" of 0.28 for the zero to 90 degrees range but 5.10 for the 90 degrees to 180 degrees range. That shows that the leakage at the zero to ninety degrees range is 0.28/5.10 equal to 0.055 or 5.5 percent of the value of the ninety to onehundred-eighty degrees range. In other words, the leakage on the upper portion of FIGS. 3 and 4 is about twenty times smaller than the leakage at the bottom portion of these Figures.

Thereby it is proven that the eccentric running of the rotor relative to the control body results in a very drastic reduction of leakage in fluid machines of the invention. The increase of efficiency of the device is thereby so considerably high that the precision of the arrangement of the invention and of its parts and rules which are set forth in the claims are very worthwhile and a considerable advancement of the technology of fluid machines is obtained.

This will be also apparent from FIG. 6 wherein a concentrically floating control body of the former art is shown in a schematic of the pressure areas thereof. According to this schematic the clearance of the former art has four leakage flows more than that of the present invention. While the present invention has only flows 39, however, smaller than in FIG. 6, the former art has additionally thereto the four leakage flows 41 and 42 because the former art requires balancing pockets 40 to obtain the concentric floating. The leakage of the former art is thereby many times higher than the leakage of the present invention.

What is claimed is:

1. A fluid machine which has in a housing an around a substantially concentrically located controlbody with a cylindrical outer face revolving rotor with fluid intaking and expelling working chambers and with a cylindrical inner face which bears and seals substantially on said outer face while fluid flows through said working chambers and through said inner and outer faces; wherein a shaft is revolvably borne in said housing with the axis of said shaft substantially coinciding with the extension of the axis of said control body while said shaft is coupled to said rotor to revolve said rotor and said shaft in unison and to permit relative radial movement of said rotor relatively to said shaft and to said control body;

wherein axially and parallel to the axis of said rotor extending reception slots are prevailed in the axially seen medial portion of said rotor which extend axially to at least one end of said medial portion of said rotor and provide in said medial portion of said rotor radially of the medial center points of said outer and inner faces plane reception faces on the walls of said slots;

wherein arms extend from an axially of said rotor located portion of said shaft radially outwards endwards of said rotor to bend radially outwards of a portion of said shaft towards said rotor and partially substantially axially along said rotor to end in fingers of suitable size to be receivable in said slots while drive faces are provided on said fingers which are at least partially parallel to said reception faces;

wherein said fingers are received in said slots and at least one of said drive faces presses against at least one of said reception faces when said rotor drives said shaft to revolve and when said shaft drives said rotor to revolve;

wherein said drive faces and reception faces slide along each other when the axes of said control body and of said rotor are distanced from each other and said sliding permits said rotor to be borne with its inner face on said outer face of said control body around which it revolves regardless of the accuratenes of the coincidence of the axes of said control body and said rotor;

whereby said rotor obtains the ability to revolve in response to fluid between said inner and outer faces slightly eccentrically around said control body to reduce leakage between said inner and said outer faces by locally narrowing the distance between said inner face and said outer face in the high pressure zone between said inner and outer face, and;

wherein said control body has a centric bore which extends axially through said control body, and, wherein said shaft has an axial extension which extends through said bore in said control body into at least the rear end of said control body to be radially borne in a respective bearing arrangement close to the rear end of said control body.

2. A fluid machine which has in a housing an around a substantially concentrically located controlbody with a cylindrical outer face revolving rotor with fluid intaking and expelling working chambers and with a cylindrical inner face which bears and seals substantially on said outer face while fluid flows through said working chambers and through said inner and outer faces; wherein a shaft is revolvably borne in said housing with the axis of said shaft substantially coinciding with the extension of the axis of said control body while said shaft is coupled to said rotor to revolve said rotor and said shaft in unison and to permit relative radial movement of said rotor relatively to said shaft and to said control body;

wherein a sealing arrangement is associated to said rotor and to said control body, wherein said housing has ports and fluid passages extending towards said control body, wherein said fluid passages extend through said control body and form control ports in said control face of said control body, wherein rotor passages extend from said rotor face through a portion of said rotor to working chambers provided in said rotor, wherein fluid can flow through one of said passages from one of said ports into at least one of said chambers and out of said chamber through another of said passages to another of said ports, wherein said sealing arrangement includes means for sealing along a portion of said faces, wherein said rotor has a substantially cylindrical and axially extending rotor-hub having an inner face, wherein said inner face is said rotor face, wherein said control body is a substantially cylindrical control body of a diameter only slightly smaller than the diameter of said rotor-hub, wherein said control body extends into said rotor, wherein said control body has a substantially cylindrical outer face, wherein said outer face is said control face, wherein wherein a small substantially cylindrical control-clearance is formed between said faces, wherein reception slots are provided in the axially seen medial portion of the rotor which extend axially to at least one end of the said rotor and provide in said medial portion of said rotor plane reception faces on the walls of said slots arms extend from said shaft in a direction to and into said rotor to end in fingers which are of a suitable size to be received in said slots, wherein drive faces are provided on said fingers and said drive faces are parallel to said reception faces, aid arms partially extend through portions of said slots, while said fingers are received in said slots and at least said drive faces are pressed against at least some of said reception faces, when said shaft drives said rotor to revolve, wherein said fingers are formed as bars with cylindrical outer faces and slide shoes which have cylindrical inner faces fitting to said outer faces are provided on said fingers with an ability to pivot slightly around said fingers, wherein said slide shoes are provided with said thrust faces, and, wherein fluid pressure pockets are provided in said thrust faces and in said slide shoes while fluid pressure communications are provided between said fingers and said slide shoes, wherein said fluid pressure pockets are communicated by respective passages to spaces which contain fluid under pressure, wherein said control body has a concentric bore which extends axially through said control body, and, wherein said shaft has an axial extension which extends through said bore in said control body into at least the rear end of said control body to be radially borne in a respective bearing arrangement close to the rear end of said control body.

* * * * *